US007005792B2

(12) United States Patent
Baek et al.

(10) Patent No.: US 7,005,792 B2
(45) Date of Patent: Feb. 28, 2006

(54) COLOR CATHODE RAY TUBE

(75) Inventors: Jae-Seung Baek, Daegu (KR); Jin-Mok Park, Daegu (KR)

(73) Assignee: LG Philips Displays Korea Co., Ltd., Kumi (KR)

( * ) Notice: Subject to any disclaimer, the term of this patent is extended or adjusted under 35 U.S.C. 154(b) by 125 days.

(21) Appl. No.: 10/643,225

(22) Filed: Aug. 19, 2003

(65) Prior Publication Data

US 2005/0073237 A1 Apr. 7, 2005

(30) Foreign Application Priority Data

Feb. 19, 2003 (KR) ..... 10-2003-0010320
Feb. 20, 2003 (KR) ..... 10-2003-0010742

(51) Int. Cl.
*H01J 31/00* (2006.01)

(52) U.S. Cl. ..... 313/477 R; 220/2.1 A; 220/2.1 R; 348/821; 348/822; 348/823

(58) Field of Classification Search ..... 313/477 R, 313/461, 479; 220/2.1 R, 2.1 A; 438/818–824
See application file for complete search history.

(56) References Cited

U.S. PATENT DOCUMENTS 6,657,374 B1 * 12/2003 Nagasawa et al. ..... 313/477 R
6,800,993 B1 * 10/2004 Tho et al. ..... 313/477 R
6,812,631 B1 * 11/2004 Murakami ..... 313/477 R
2003/0025439 A1 * 2/2003 Fujita ..... 313/477 R
2003/0168963 A1 * 9/2003 Baek ..... 313/477 R
2004/0051437 A1 * 3/2004 Kim ..... 313/440
2005/0052113 A1 * 3/2005 Kim ..... 313/477 R

FOREIGN PATENT DOCUMENTS

JP 2000306528 A * 11/2000
KR 2002076830 A * 10/2002
KR 2004044067 A * 5/2004

* cited by examiner

*Primary Examiner*—Mariceli Santiago
(74) *Attorney, Agent, or Firm*—Birch, Stewart, Kolasch & Birch, LLP

(57) ABSTRACT

A color cathode ray tube including: a panel having a substantially flat outer surface and an inner surface having a curvature; a funnel coupled to the panel; a deflection yoke installed at an outer surface of the funnel; and a reinforcing band installed at a skirt portion of the panel, wherein the panel and the funnel satisfy the following condition, $U/U' \geqq 2.5$, when a diagonal size of an effective surface of the panel is U, and a tube axis directional distance from an outer surface center of the panel to a boundary portion (TOR) between a body part and a yoke part of the funnel is U', so that in the color cathode ray tube of the present invention, a lightness and slimness of a panel can be accomplished, and in order to compensate the weak structural strength caused in this case, a reinforcing band position (h) is set in the range of 10.5 mm~20 mm to implement an optimum tensile force.

20 Claims, 3 Drawing Sheets

COLOR CATHODE RAY TUBE

This nonprovisional application claims priority under 35 U.S.C. § 119(a) on Patent Application No(s). 10-2003-0010320 filed in KOREA on Feb. 19, 2003 and 10-2003-0010742 filed in KOREA on Feb. 20, 2003, which is(are) herein incorporated by reference.

BACKGROUND OF THE INVENTION

1. Field of the Invention

The present invention relates to a color cathode ray tube (CRT) and, more particularly, to a color cathode ray tube in which structure of the cathode ray tube is optimally made light and slim.

2. Description of the Related Art

In general, a cathode ray tube is a sort of the widely used display device, which implements an image as electron beams from an electron gun therein hit a phosphor screen in a high pressure vacuum state.

FIG. 1 is a partially sectioned side view showing an interior of a general color CRT As shown in FIG. 1, a general color cathode ray tube includes: a panel 1 formed with a substantially flat outer surface and an inner surface with a certain curvature; a shadow mask 2 disposed with at a certain interval from the inner side of the panel 1; a funnel coupled to the panel 1; a seal edge line 4 formed at a connecting portion between the funnel 3 and the panel 1; an electron gun 5 mounted at a neck portion of the funnel 3 for emitting electron beams; a deflection yoke 6 encompassing the outer side of the funnel 3; and a reinforcing band 7 installed at a skirt portion 1*b* of the panel 1 to prevent implosion. S denotes a tube axis.

In the general color CRT constructed as described above, when the electron gun 5 receives an image signal, the electron gun 5 emits an electron beam, and the emitted electron beam is accelerated-focused toward a phosphor screen deposited on an inner surface of the panel 1 by a voltage applied to each electrode of the electron gun 5.

The electron beam is deflected by the deflection yoke 6, and color selecting is performed while the electron beam passes through slots (not shown) formed at the mask, and the phosphor screen is irradiated by the electron beam landing on the phosphor screen 1*a* at the internal surface of the panel 1.

In this manner, the color CRT has such a principle that an image is formed when electron beams reach the phosphor screen deposited on an inner surface of the panel, and the interior of the CRT is maintained in a high vacuum state so that the electron beams can be smoothly moved.

Because the color CRT is made of glass and its interior is maintained in the high vacuum state, a compression force is applied to the inside of the CRT due to an atmospheric pressure. In this case, the peripheral portion and an edge portion of the CRT receive more vacuum stress than other portions, and thus are very weak in terms of structure.

Presently, in the field of display, the display is necessarily made slim to accomplish reduction of cost, obtaining of an installation space and light weight.

In this respect, however, the lighter and slimmer the color CRT is, the weaker its structural strength is.

FIG. 2 is a schematic view showing deformation of a panel of a conventional color CRT.

As shown in FIG. 2, during a process of evacuation for vacuum, the outer surface of the panel 1 and a body portion 3*a* of the funnel 3 sag inwardly while a skirt portion 1*b* of the panel 1 swells to be deformed outwardly as indicated in broken lines.

The thusly deformed portion is recovered to its original state when the reinforcing band 7 is engaged to the skirt portion 1*b* of the panel 1. The recovery rate at this time is equivalent to the recovery amount by the reinforcing band/sagging degree due to vacuum.

However, the conventional color CRT fails to optimize a width of the reinforcing band and a reinforcing band position, so there is a limitation to make the color CRT lighter and slimmer.

SUMMARY OF THE INVENTION

Therefore, an object of the present invention is to provide a color CRT in which a reinforcing band position is optimized in order to effectively compensate a structural strength that is inevitably weakened as a CRT is increasingly light and slim.

To achieve these and other advantages and in accordance with the purpose of the present invention, as embodied and broadly described herein, there is provided a color cathode ray tube, comprising: a panel having a substantially flat outer surface and an inner surface having a curvature; a funnel coupled to the panel; a deflection yoke installed at an outer surface of the funnel; and a reinforcing band installed at a skirt portion of the panel, wherein the panel and the funnel satisfy the following condition, $U/U' \geqq 2.5$, when a diagonal size of an effective surface of the panel is U, and a tube axis directional distance from an outer surface center of the panel to a boundary portion (TOR) between a body part and a yoke part of the funnel is U'.

In addition, a maximum deflection angle of a electron beam is about 100°~140°.

The panel and funnel satisfy the following condition, $U/L \geqq 2.5$, when a tube axis directional distance from the outer surface center of the panel to a deflection reference line (RL) of the funnel is L.

The panel and funnel satisfy the following condition, $L/OL \leqq 0.55$, when a tube axis directional distance from the outer surface center of the panel to a deflection reference line (RL) of the funnel is L and a tube axis directional distance from the outer surface center of the panel to an end portion of the funnel is OL.

The panel satisfies the following condition, $6.5 \leqq U/OAH \leqq 12.5$, when a tube axis directional height of the panel is OAH.

The reinforcing band satisfies the following condition, $h \geqq 7$ mm, when a tube axis directional distance from the outer surface center of the panel to a front edge portion of the reinforcing band is h.

The reinforcing band satisfies the following condition, $10.5 \text{ mm} \leqq h \leqq 20 \text{ mm}$.

The panel and reinforcing band satisfy the following condition, $0.55 \leqq W/OAH \leqq 0.8$, when a width of the reinforcing band is W and a tube axis directional height of the panel is OAH.

The panel and reinforcing band satisfy the following condition, $0.35 \leqq BP/OAH \leqq 0.65$, when a tube axis directional distance from a connecting portion of the panel and the funnel to the reinforcing band center is BP and a tube axis directional height of the panel is OAH.

A vertical section surface of a yoke part of the funnel is about non-circular shape.

In the meantime, as another embodiment of the present invention, in a color CRT including: a panel having an substantially flat outer surface and an inner surface having a curvature; a funnel coupled to the panel; a deflection yoke installed at an outer surface of the funnel; and a reinforcing band installed at a skirt portion of the panel, wherein the panel and the funnel satisfy the following condition, $U/L \geqq 2.0$, when a diagonal size of an effective surface of the panel is U and a tube axis directional distance from the outer surface center of the panel to a deflection reference line (RL) of the funnel is L.

The panel and the funnel satisfy the following condition, $2.4 \leqq U/L \leqq 5.5$.

The panel and the funnel satisfy the following condition, $L/OL \leqq 0.55$, when a tube axis directional distance from the outer surface center of the panel to an end portion of the funnel is OL.

The panel and the funnel satisfy the following condition, $6.5 \leqq U/OAH \leqq 12.5$, when a tube axis directional height of the panel is OAH.

The reinforcing band satisfies the following condition, $h \geqq 7$ mm, when a tube axis directional distance from the outer surface center of the panel to a front edge portion of the reinforcing band is h.

The reinforcing band satisfies the following condition, $10.5 \text{ mm} \leqq h \leqq 20$ mm.

The panel and reinforcing band satisfy the following condition, $0.55 \leqq W/OAH \leqq 0.8$, when a width of the reinforcing band is W and a tube axis directional height of the panel is OAH.

The panel and reinforcing band satisfy the following condition, $0.35 \leqq BP/OAH \leqq 0.65$, when a tube axis directional distance from a connecting portion of the panel and the funnel to the reinforcing band center is BP and a tube axis directional height of the panel is OAH.

A vertical section surface of the yoke part of the funnel is about rectangular shape.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

For a better understanding of the present invention, some marks are given to position, shape and a tube axis directional distance of a color CRT, based on which the color CRT of the present invention will now be described.

Figure 1:
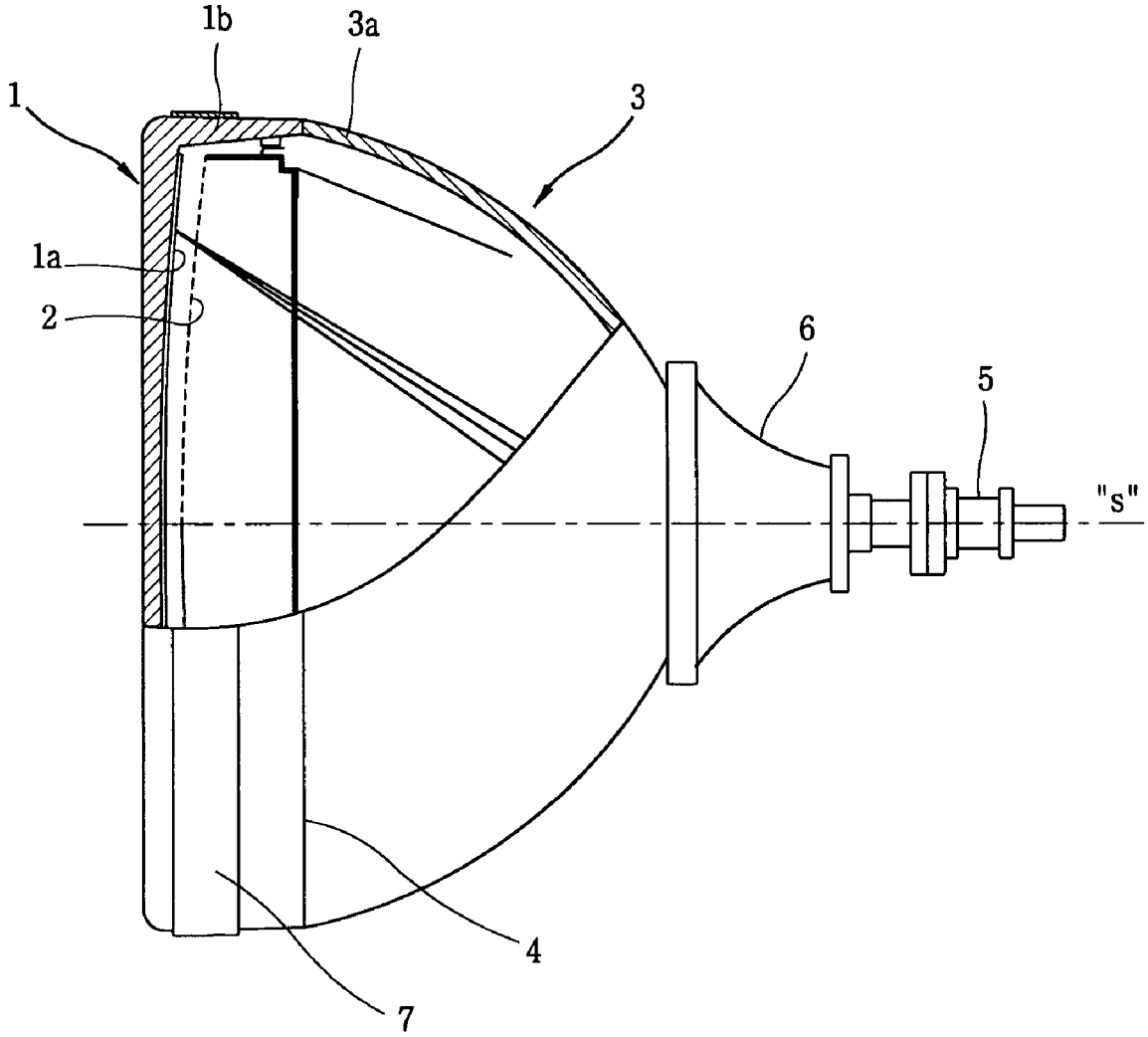
FIG. 1 RELATED ART
FIG. 1 is a partially sectioned side view showing an interior of a general color CRT.
Figure 2:
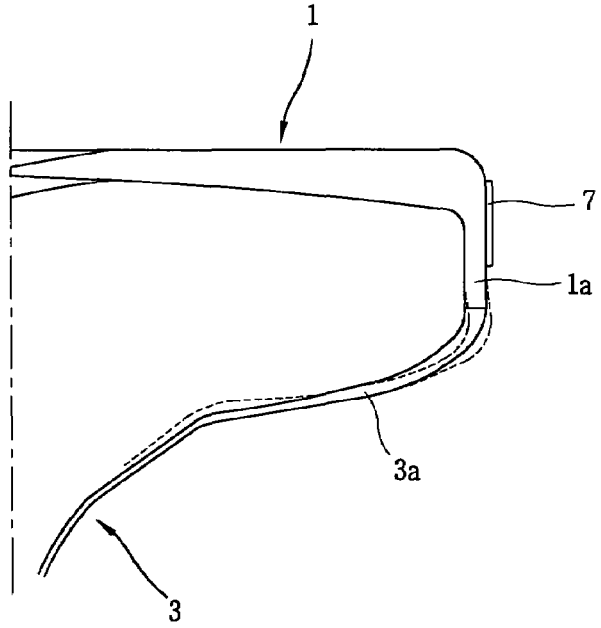
FIG. 2 RELATED ART
FIG. 2 is a schematic view showing deformation of a panel of a conventional color CRT.
Figure 3:
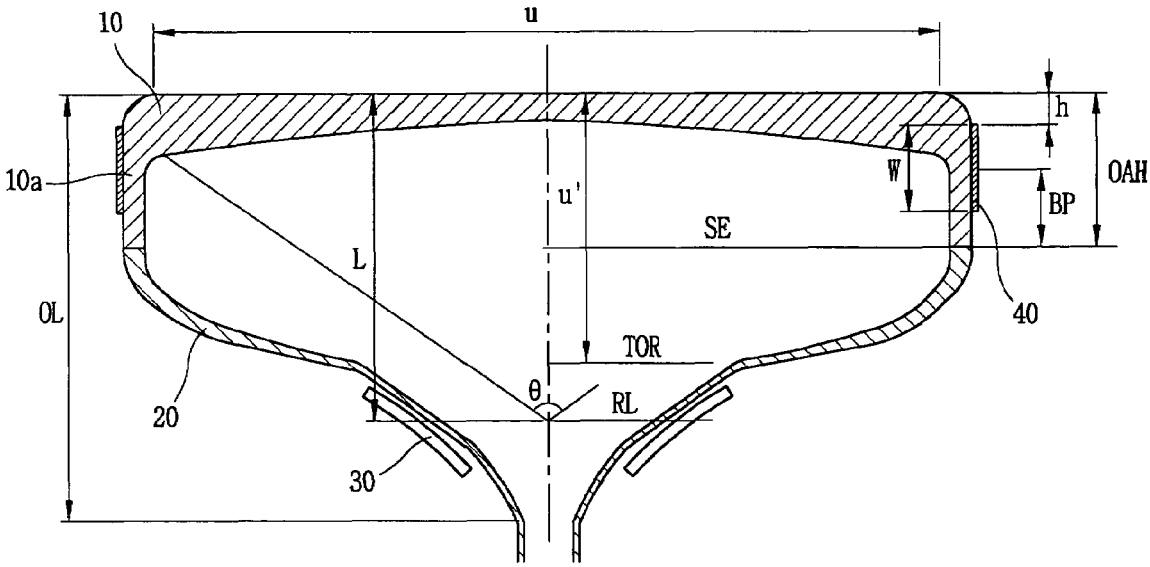
FIG. 3 is a vertical section view showing a structure of a color CRT in accordance with a present invention.

FIG. 3 is a vertical section view showing a structure of a color CRT in accordance with a present invention.

With reference to FIG. 3, a diagonal size of an effective surface is U; a tube axis directional distance from an outer surface center of a panel to a boundary portion between a body part and a yoke part of a funnel is U'; a tube axis directional distance from the outer surface center of the panel to a defection reference line of the funnel is L; a tube axis directional distance from the outer surface center of the panel to an end portion of the funnel is OL; a tube axis directional height of the panel is OAH; a tube axis directional distance from the outer surface center of the panel to a front edge portion of the reinforcing band is h; a width of the reinforcing band is W, and a tube axis directional distance from a connecting portion (SE) of the panel and funnel to the reinforcing band center is BP.

As shown in FIG. 3, the color CRT of the present invention includes: a panel 10 having an substantially flat outer surface and an inner surface having a curvature; funnel 20 coupled to the panel 10; a deflection yoke 30 installed at an outer circumferential surface of the funnel 20; and a reinforcing band 40 installed a skirt portion 10*a* of the panel 10, wherein the value U/U' is set greater than or equal to 2.5.

Thus, In case of CDT for a monitor, a maximum deflection angle (Θ) of a electron beam is about 100°~140°, while in case of CPT for a TV set, a maximum deflection angle of electron beam is about 135°~140°.

The value U/L is set greater than or equal to 2.0, the value L/OL is set greater than or equal to 0.55, and the panel satisfies the following condition, $6.5 \leqq U/OAH \leqq 12.5$.

The value U/U' is set greater than or equal to 2.4 and the value U/L is set greater than or equal to 2.0 means that U' is reduced by more than 2.5 times compared to the U and the L is reduced by more than two times, resulting in a slimmer the color CRT.

In other words, generally, the U is fixed to be constant by products, for example, at the size of 17 inch and 21 inch, so there is a limitation to increase U.

Meanwhile, the U' or the L can be arbitrarily set depending on how much the color CRT is to be slim. The value U/U' and the value U/L represent a contour of the color CRT, and how slim the color CRT is to be or its maximum deflection angle are determined according to the size of the value U/U' and the value U/L.

The smaller the U or the L is, the slimmer the color CRT can be, but then a problem arises with respect to an implosion and a structural strength, so the size should be limited within a specific range.

In the present invention, the value U/L is limited greater than or equal to 2.0, while the value L/OL is limited to less than or equal to 0.55.

Thus, unlike the conventional color CRT, the color CRT of the present invention in constructed such that the value U/U' is set greater than or equal to 2.5 and the value U/L is set greater than or equal to 2.0 to accomplish a light and slim color CRT, and a structural strength is resolved by improving a reinforcing band position, for which, in the case of the CDT for a monitor, a maximum deflection angle of electron beam is about 100°~140°, preferably 120°, while in case of the CPT for a TV set, a maximum deflection angle is about 135°~140°.

When the color CRT is slim, OAH is also reduced. In this case, however, OAH can not be limitlessly reduced because of a problem with respect to the implosion and the structural strength.

If the value U/OAH is smaller than 6.5, the OAH is greater than the U, resulting in that the color CRT is too much increased in weight and a production cost is increased.

If, however, the value U/OAH is greater than 12.5, the OAH is smaller than U', resulting in that a color CRT weakens in its structural strength, and in case of a small color CRT, it is difficult to secure a space for installing the reinforcing band. Therefore, the value U/OAH representing a size range of the OAH is preferably limited to 6.5~12.5.

As mentioned above, in the color CRT, the U', the L or the OAH is reduced to make the color CRT slim and light, and in this respect, in order to effectively compensate the structural strength, a reinforcing band position is determined as follows.

That is, in the color CRT of the present invention, assuming that a tube axis directional distance from an outer surface center of the panel to the front edge portion of the reinforcing band is h, the h is set greater than or equal to 7 mm, preferably, 10.5 mm≦h≦20 mm, which will now be described with reference to Table 1 and FIG. 4.

Table 1 is a result obtained by varying the reinforcing band position of a color CRT with a value U/U' of 2.96, showing a displacement and a recovery rate of an outer surface of the panel and a tensile stress of a panel.

TABLE 1

| Classification | Embodiment 1 | Embodiment 2 | Embodiment 3 | Embodiment 4 | Embodiment 5 | Embodiment 6 | Embodiment 7 |
|---|---|---|---|---|---|---|---|
| h | 8 | 10.5 | 13 | 15.5 | 18 | 20.5 | 23 |
| R (recovery amount by reinforcing band | 272.9 | 237.5 | 198.3 | 162.4 | 134.6 | 96.8 | 56.7 |
| Recovery rate | −17% | −2% | 15% | 30% | 42% | 58% | 76% |

Figure 4:
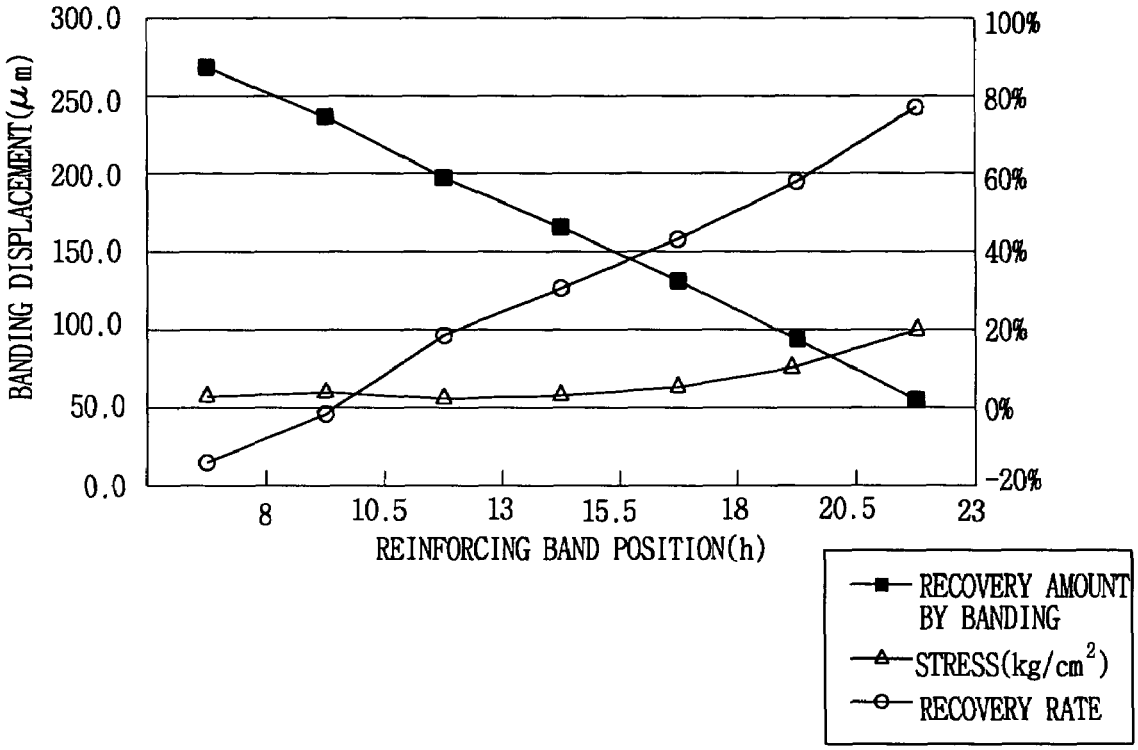
FIG. 4 is a graph showing an optimized reinforcing band position in the color CRT in accordance with the present invention.

As noted in Table 1 and FIG. 4, the more the reinforcing band position increases, the more a recovery rate by the reinforcing band is reduced and the more the recovery rate increases.

In embodiments 1 and 2 where the h is less than or equal to 10.5, the recovery rate has a minus (−) value, which means that there is no recovery amount by the reinforcing band and a displacement of the panel rather increases. Thus, in order to have a plus (+) value, the h is preferably set greater than or equal to 10.5 mm.

In addition, if the h is greater than or equal to 20.5 mm, a distance between the outer surface of the panel and the reinforcing band is too long, so a tension stress increases and a stress increasingly applied to connecting portion (SE), weakening the structural strength.

Therefore, the h is most preferably set greater than or equal to 10.5 mm and less than or equal to 20.5 mm.

When a width of the reinforcing band is W, it is set such that 0.55≦W/OAH≦0.8.

The W/OAH is in the range of 0.55~0.8 means that a width of the reinforcing band is determined in the range of 55% to 80% of the OAH.

The reason to have such a range is to obtain stronger tensile force by widening the reinforcing band within the range, because the slimmer the color CRT becomes, the more tensile force is required.

When a tube axis directional distance from the connecting portion (SE) to the reinforcing band center is BP, the panel and reinforcing band satisfy the following condition, 0.35≦BP/OAH≦0.65, which will now be described with reference to FIG. 5.

Figure 5:
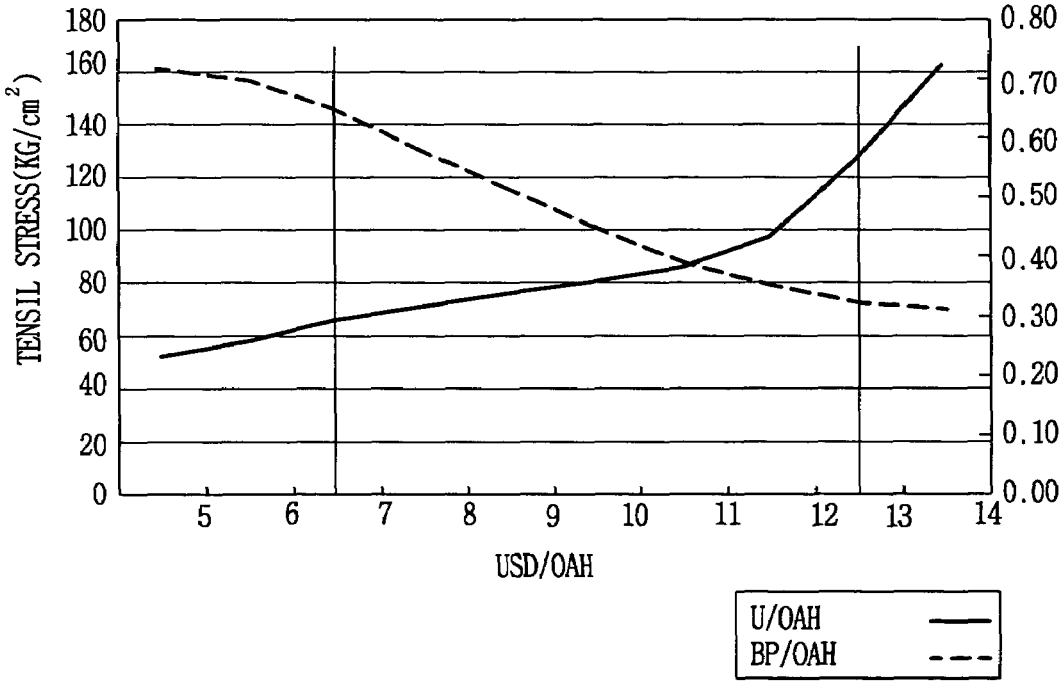
FIG. 5 is a graph showing a tensile stress for value U/OAH and value BP/OAH and an reinforcing band position in the color CRT in accordance with the present invention.

FIG. 5 is a graph showing a tension stress for value U/OAH and value BP/OAH and a reinforcing band position, in which a horizontal axis is value U/OAH, left side of a vertical axis is a tension stress, right side of the vertical axis is a reinforcing band position, a curved line 1 is a curved line of the value U/OAH, and a curved line 2 is a curved line of the value BP/OAH.

As shown in FIG. 5, when the value U/OAH ranges from 6.5 to 12.5, a reinforcing band position satisfying the curved line 1 and the curved line 2 is 0.35 to 0.65, and accurately, it is 0.36.

If the value BP/OAH is smaller than 0.35, a tube axis directional distance between the connecting portion and the reinforcing band is too close. Then, too much tensile force is applied to the connecting portion, increasing a tension stress at the connecting portion, and thus a crack is generated.

If, however, the value BP/OAH is greater than 0.65, because the OAH is reduced, more tension stress is applied to the connecting portion and a structural strength is weakened.

Consequently, as shown in FIG. 5, in case that 6.5≦U/OAH≦12.5 and 0.35≦BP/OAH≦0.65, a color CRT can be made slim having the value U/U' of greater than or equal to 2.5 and the value U/L of greater than or equal to 2.0.

As so far described, the color cathode ray tube of the present invention has the following advantage.

That is, because the value U/U' (ratio relationship of a diagonal size of an effective surface of the panel to a tube axis directional distance from an outer surface center of the panel to a boundary portion (TOR) between a body part and a yoke part of the funnel) is set greater than or equal to 2.5, and the value U/L (ratio relationship of the diagonal size of the effective surface of the panel to the tube axis directional distance between the outer surface center of the panel and the deflection reference line (RL) of the funnel) is set greater than or equal to 2.0.

In the color CRT of the present invention, a lightness and slimness of panel can be accomplished, and in order to compensate the weak structural strength caused in this case, the reinforcing band position (h) is set in the range of 10.5 mm~20 mm to implement an optimum tensile force.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A color cathode ray tube, comprising: a panel having a substantially flat outer surface and an inner surface having a curvature; a funnel coupled to the panel; a deflection yoke installed at an outer surface of the funnel; and a reinforcing band installed at a skirt portion of the panel, wherein the panel, the funnel, and the reinforcing band satisfy the following condition, $U/U' \geqq 2.5$ and $10.5\ mm \leqq h \leqq 20\ mm$, wherein a diagonal size of an effective surface of the panel is U, a tube axis directional distance from an outer surface center of the panel to a boundary portion (TOR) between a body part and a yoke part of the funnel is U', and a tube axis directional distance from the outer surface center of the panel to a front edge portion of the reinforcing band is h.

2. The CRT of claim 1, wherein a maximum deflection angle of a electron beam is about 100°~140°.

3. The CRT of claim 1, wherein the panel and funnel satisfy the following condition, $U/L \geqq 2.5$, when a tube axis directional distance from the outer surface center of the panel to a deflection reference line (RL) of the funnel is L.

4. The CRT of claim 1, wherein the panel satisfies the following condition, $6.5 \leqq U/OAH \leqq 12.5$, when a tube axis directional height of the panel is OAH.

5. The CRT of claim 1, wherein a vertical section surface of a yoke part of the funnel is about non-circular shape.

6. A color cathode ray tube, comprising: a panel having a substantially flat outer surface and an inner surface having a curvature; a funnel coupled to the panel; a deflection yoke installed at an outer surface of the funnel; and a reinforcing band installed at a skirt portion of the panel, wherein the panel and funnel satisfy the following condition, $U/U' \geqq 2.5$ and $L/OL \leqq 0.55$, wherein a diagonal size of an effective surface of the panel is U, a tube axis directional distance from an outer surface center of the panel to a boundary portion (TOR) between a body part and a yoke part of the funnel is U', a tube axis directional distance from the outer surface center of the panel to a deflection reference line (RL) of the funnel is L, and a tube axis directional distance from the outer surface center of the panel to an end portion of the funnel is OL.

7. A color cathode ray tube, comprising: a panel having a substantially flat outer surface and an inner surface having a curvature; a funnel coupled to the panel; a deflection yoke installed at an outer surface of the funnel; and a reinforcing band installed at a skirt portion of the panel, wherein the panel, the funnel, and reinforcing band satisfy the following condition, $U/U' \geqq 2.5$ and $0.55 \leqq W/OAH \leqq 0.8$, wherein a diagonal size of an effective surface of the panel is U, a tube axis directional distance from an outer surface center of the panel to a boundary portion (TOR) between a body part and a yoke part of the funnel is U', and a width of the reinforcing band is W and a tube axis directional height of the panel is OAH.

8. The CRT of claim 7, wherein the reinforcing band satisfies the following condition $h \geqq 7$ mm, wherein a tube axis directional distance from the outer surface center of the panel to a front edge portion of the reinforcing band is h.

9. A color cathode ray tube, comprising: a panel having a substantially flat outer surface and an inner surface having a curvature; a funnel coupled to the panel; a deflection yoke installed at an outer surface of the funnel; and a reinforcing band installed at a skirt portion of the panel, wherein the panel, the funnel, and the reinforcing band satisfy the following condition, $U/U' \geqq 2.5$ and $0.35 \leqq BP/OAH \leqq 0.65$, wherein a diagonal size of an effective surface of the panel is U, a tube axis directional distance from an outer surface center of the panel to a boundary portion (TOR) between a body part and a yoke part of the funnel is U', a tube axis directional distance from a connecting portion of the panel and the funnel to the reinforcing band center is BP, and a tube axis directional height of the panel is OAH.

10. The CRT of claim 9, wherein the reinforcing band satisfies the following condition $h \geqq 7$ mm, wherein a tube axis directional distance from the outer surface center of the panel to a front edge portion of the reinforcing band is h.

11. A color cathode ray tube, comprising: a panel having an substantially flat outer surface and an inner surface having a curvature; a funnel coupled to the panel; a deflection yoke installed at an outer surface of the funnel; and a reinforcing band installed at a skirt portion of the panel, wherein the panel, the funnel, and the reinforcing band satisfy the following condition, $U/L \geqq 2.0$ and $10.5\ mm \geqq h \geqq 20\ mm$, wherein a diagonal size of an effective surface of the panel is U, a tube axis directional distance from the outer surface center of the panel to a deflection reference line (RL) of the funnel is L, and a tube axis directional distance from the outer surface center of the panel to a front edge portion of the reinforcing band is h.

12. The CRT of claim 11, wherein the panel and the funnel satisfy the following condition, $2.4 \leqq U/L \leqq 5.5$.

13. The CRT of claim 11, wherein the panel and the funnel satisfy the following condition, $6.5 \leqq U/OAH \leqq 12.5$, when a tube axis directional height of the panel is OAH.

14. The CRT of claim 11, wherein a vertical section surface of the yoke part of the funnel is about rectangular shape.

15. The CRT of claim 11, wherein a maximum deflection angle of electron beam is about 100°~140°.

16. A color cathode ray tube, comprising:

a panel having an substantially flat outer surface and an inner surface having a curvature; a funnel coupled to the panel; a deflection yoke installed at an outer surface of the funnel; and a reinforcing band installed at a skirt portion of the panel, wherein the panel and the funnel satisfy the following condition, $U/L \geqq 2.0$ and $L/OL \leqq 0.55$, wherein a diagonal size of an effective surface of the panel is U, a tube axis directional distance from the outer surface center of the panel to a deflection reference line (RL) of the funnel is L, and a tube axis directional distance from the outer surface center of the panel to an end portion of the funnel is OL.

17. A color cathode ray tube, comprising: a panel having an substantially flat outer surface and an inner surface having a curvature; a funnel coupled to the panel; a deflection yoke installed at an outer surface of the funnel; and a reinforcing band installed at a skirt portion of the panel, wherein the panel, the funnel, and reinforcing band satisfy the following condition, $U/L \geqq 2.0$ and $0.55 \leqq W/OAH \leqq 0.8$, wherein a diagonal size of an effective surface of the panel is U, a tube axis directional distance from the outer surface center of the panel to a deflection reference line (RL) of the funnel is L, and a width of the reinforcing band is W and a tube axis directional height of the panel is OAH.

18. The CRT of claim 17, wherein the reinforcing band satisfies the following condition $h \geqq 7$ mm, wherein a tube axis directional distance from the outer surface center of the panel to a front edge portion of the reinforcing band is h.

19. A color cathode ray tube, comprising: a panel having an substantially flat outer surface and an inner surface having a curvature; a funnel coupled to the panel; a deflection yoke installed at an outer surface of the funnel; and a reinforcing band installed at a skirt portion of the panel, wherein the panel, the funnel, and reinforcing band satisfy the following condition, $U/L \geqq 2.0$ and $0.35 \leqq BP/OAH \leqq 0.65$, wherein a diagonal size of an effective surface of the panel is U, a tube axis directional distance from the outer surface center of the panel to a deflection reference line (RL) of the funnel is L, a tube axis directional distance from a connecting portion of the panel and the funnel to the reinforcing band center is BP, and a tube axis directional height of the panel is OAH.

20. The CRT of claim 19, wherein the reinforcing band satisfies the following condition $h \geqq 7$ mm, wherein a tube axis directional distance from the outer surface center of the panel to a front edge portion of the reinforcing band is h.

* * * * *